US006152718A

United States Patent [19]

Kobayashi

[11] Patent Number: 6,152,718

[45] Date of Patent: Nov. 28, 2000

[54] POSITIVE-DISPLACEMENT PISTON MECHANISM HAVING A ROTARY PISTON STRUCTURE

[75] Inventor: Hiroshi Kobayashi, deceased, late of Tokyo, Japan, by Tsuya Kobayashi, heir

[73] Assignee: Takeshi Sato, Tokyo, Japan

[21] Appl. No.: 09/004,059

[22] Filed: Jan. 8, 1998

[30] Foreign Application Priority Data

Nov. 17, 1997 [JP] Japan ..... 9-314885

[51] Int. Cl.[7] ..... F03C 2/00

[52] U.S. Cl. ..... 418/174; 418/172; 418/173; 418/177; 418/236

[58] Field of Search ..... 418/172, 173, 418/174, 236, 177

[56] References Cited

U.S. PATENT DOCUMENTS

| | | | |
|---|---|---|---|
| 3,565,558 | 2/1971 | Tobacman | 418/150 |
| 3,844,685 | 10/1974 | Eickmann | 418/173 |
| 3,886,909 | 6/1975 | Balsbaugh | 418/173 |
| 4,006,804 | 2/1977 | Fehr | 418/177 |
| 4,125,031 | 11/1978 | Swain | 418/173 |
| 4,163,635 | 8/1979 | Sakamaki et al. | 418/236 |
| 4,990,074 | 2/1991 | Nakagawa | 418/172 |
| 5,073,097 | 12/1991 | Pipalov | 418/175 |
| 5,567,139 | 10/1996 | Weatherson | 418/173 |

FOREIGN PATENT DOCUMENTS

| | | | |
|---|---|---|---|
| 2542041 | 9/1984 | France . | |
| 901630 | 2/1982 | U.S.S.R. | 418/174 |
| 989142 | 1/1983 | U.S.S.R. | 418/174 |
| 9591 | 5/1908 | United Kingdom . | |

*Primary Examiner*—Thomas Denion
*Assistant Examiner*—Theresa Trieu
*Attorney, Agent, or Firm*—Oliff & Berridge, PLC

[57] ABSTRACT

A positive-displacement piston mechanism includes a small rotor integrated with a main axis and biased against a cylindrical large rotor for holding a bearing-housing. Slant sliding slots are formed at facing places in equally divided space between the large rotor and the small rotor. Vanes having an angle are fitted into the slots as if they were bridges, and an inlet and an outlet are provided on side-housings.

4 Claims, 8 Drawing Sheets

POSITIVE-DISPLACEMENT PISTON MECHANISM HAVING A ROTARY PISTON STRUCTURE

BACKGROUND OF THE INVENTION

1. Field of the Invention

This invention relates to a positive-displacement piston mechanism having a rotary piston structure.

2. Description of Related Art

A positive-displacement piston mechanism which has a reversible relation with internal combustion engines, such as a pump, a blower, a compressor and the like, including a vane type rotary mechanism having a rotary piston structure, has been already utilized. For example, in a a rotary blower shown in FIG. 8, blades (5) are biasedly arranged for flexibly moving in radial slots (4) of a rotor (3) provided in a circle-shaped chamber portion (2) of a squared box (1). Then, the air and/or other fluid are pushed out from an inlet into an outlet by the blades (5) flexibly moving in the slots (4) of the rotor (3) rotating at high speed and increasing the pressure by centrifugal force inside of the circle-shaped chamber portion (2).

There are difficult technical problems associated with a vane type rotary mechanism mentioned above, including abrasion at the edges of the vanes, and difficult obtainment of airtightness and smooth operation of a seal between the vanes and the chamber portion.

SUMMARY OF THE INVENTION

The technical problems of the prior art can be overcome by a positive-displacement piston mechanism having a rotary piston structure shown below.

A positive-displacement piston mechanism according to the invention includes:

- a small rotor integrated with a main axis and biased against a cylinder-type large rotor for holding a bearing-housing,
- slant sliding slots made at facing places in equally divided space between the large rotor and small rotor,
- vanes having a predetermined angle fitted into the slots as if they were bridges, and
- an inlet and an outlet provided at positions on side-housings.

In the invention, since both the large rotor and the small rotor rotate at the same time through the bridged bent vanes at a balancing point, capacity-change is carried out by the movement of the vanes in the sliding slots without spoiling smoothness of rotation and sealing effect. Accordingly, the invention can completely improve one of the most difficult points in the traditional mechanism, which strongly forced edges of cantilever projected vanes against a wall of the chamber portion.

DESCRIPTION OF THE PREFERRED EMBODIMENTS

Figure 1:
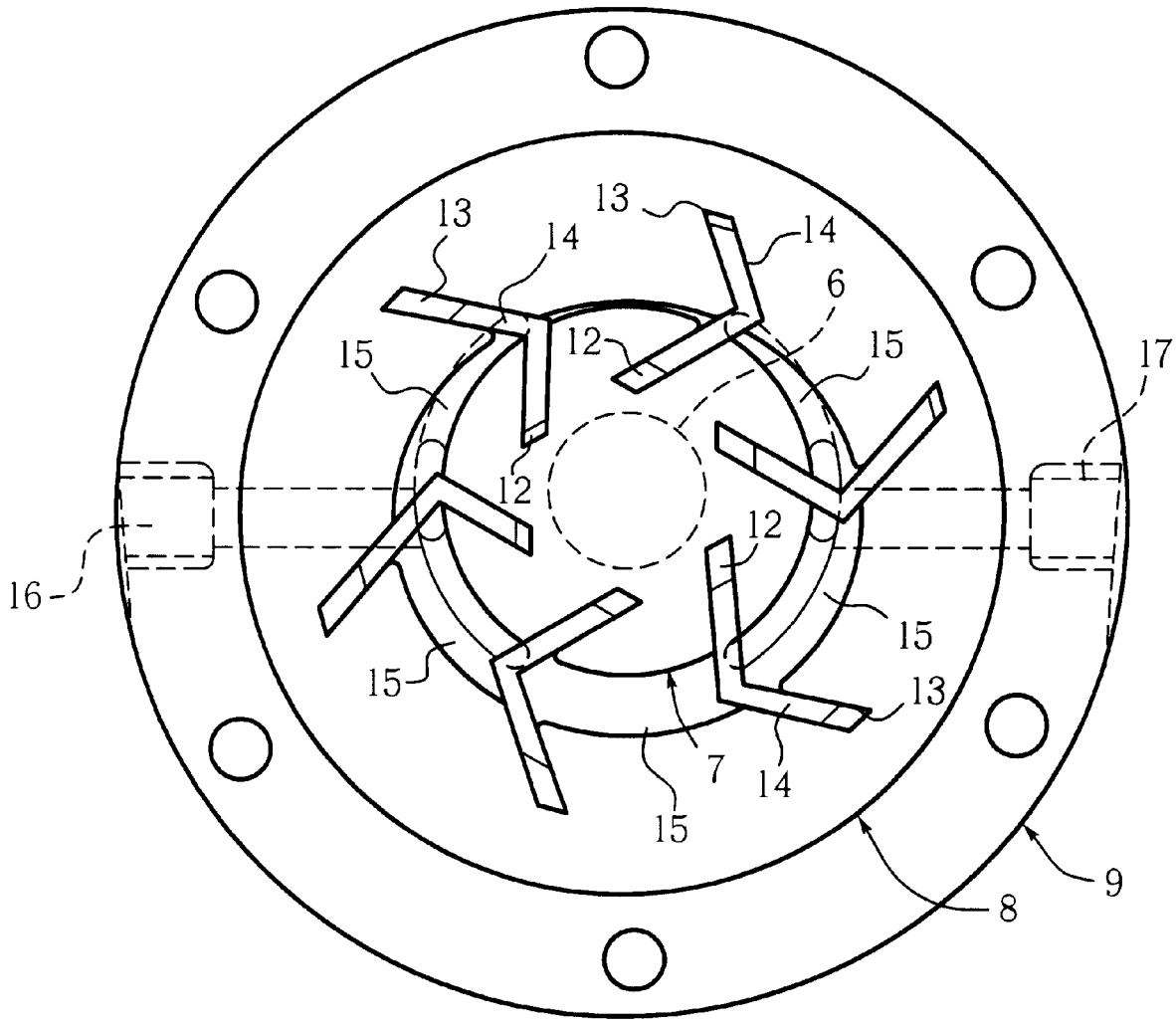
FIG. 1 is a front view of a vane pump, according to the invention.

An exemplary embodiment according to invention is explained by reference to FIGS. 1 and 2.

A small rotor (7) integrated with a main axis (6) is eccentrically arranged against a large rotor (8) in the form of a ring-shaped cylinder. The large rotor (8) is surrounded by a bearing-housing (9).

The small rotor (7,) and the large rotor (8) are set at the space between the side-housings (10) and (10') which are fixed by bolts (11). A pair of slant sliding slots (12) and (13) are provided at each position where the small rotor (7) and the large rotor (8) oppose each other, and vanes (14) which are bent are set at the positions between the slots (12) and (13) like bridges.

The large rotor (8) rotates together with the small rotor (7) through the bent vanes (14) constantly seeking a balancing point. In the rotary mechanism, the divided chambers (15) are formed by the bent vanes (14), and these chambers (15) can change their capacities according to the rotors' (7) and (8) rotation. At that time, the vanes (14) only move in the sliding slots (12) and (13).

The rotary mechanism according to the invention allows for changing of the capacity without the problems associated with the traditional vane-type rotary mechanism in which change of capacity was reached by pushing and moving edges of cantilever projected vanes on a fixed cam-ring.

Figure 3:
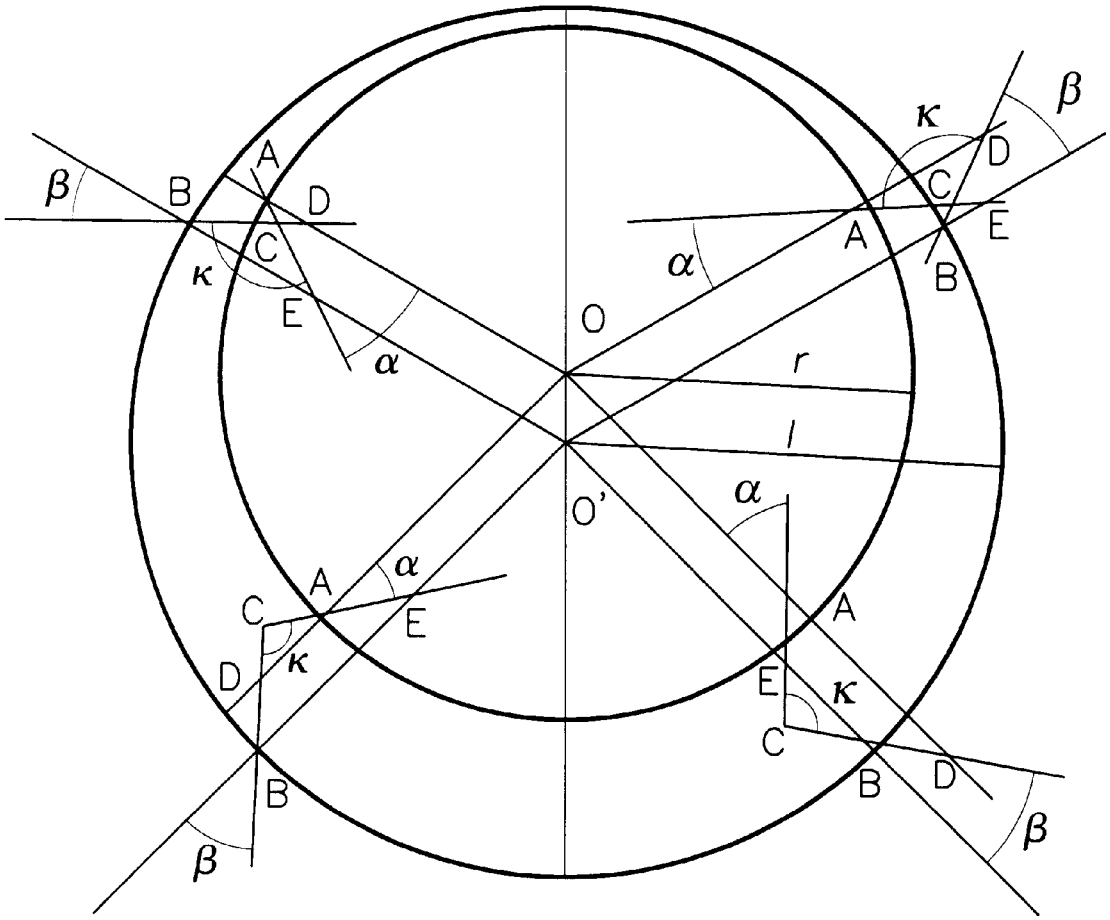
FIG. 3 is a geometrical drawing of the angles of the vanes according to the invention.
Figure 4:
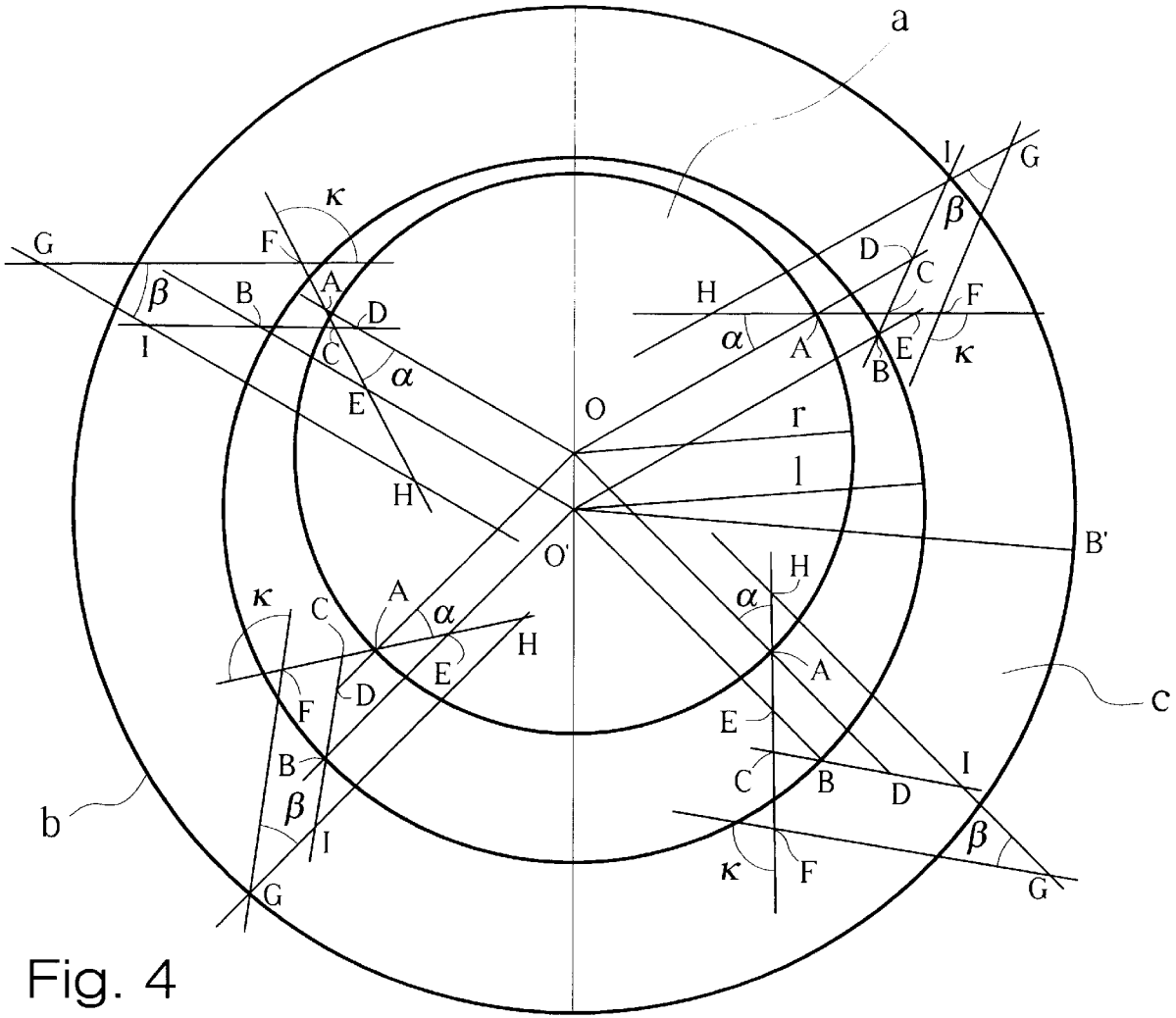
FIG. 4 is a geometrical drawing of the angles of the vanes according to the invention.
Figure 5:
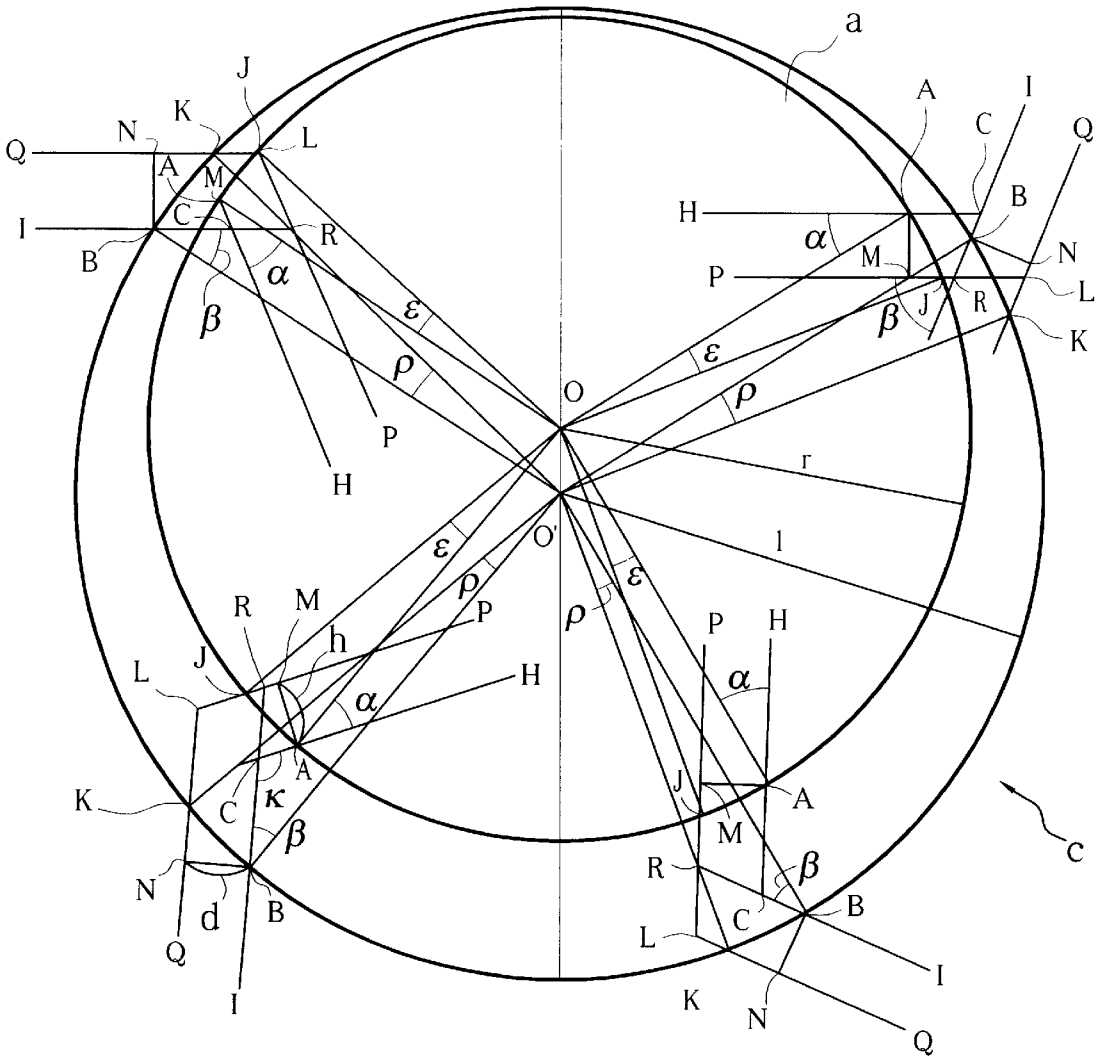
FIG. 5 is a geometrical drawing of the angles of the vanes according to the invention.

FIGS. 3–5 show how the angles of the vanes (14) of the invention are determined. FIG. 3 shows that O is a central point of a small circle of a radius r and O' is a central point of a large circle of a radius 1. The two radiuses OA and O'B remain parallel as small rotor (7) and large rotor (8) rotate.

When the radiuses OA and O'B are kept parallel at a selected turning position, a drawing thereof can be made as shown in FIG. 3.

When drawing a straight line AC forming a constant-angle $\alpha$ with the radius OA through a point A of the radius OA, the angle $\alpha$ becomes an acute supplemental angle. As the next step, when drawing a straight line BC forming an acute angle $\beta$ with the radius O'B through a point B of the radius O'B, the angle $\beta$ becomes an acute supplemental angle. At a crossing point C of two straight lines AC and BC, a crossing angle $\kappa$ is formed.

On the above drawing, $\angle CDA=\angle CBE=\beta$ because of OA/O'B. In $\Delta CAD$, $\angle CAD=\alpha$, $\angle CDA=\beta$, $\angle ACD=\kappa$, $\angle CAD+\angle CDA+\angle ACD=\alpha+\beta\kappa=180°$, and $\kappa=180-(\alpha+\beta)$, therefore, $\kappa$ also becomes a constant angle because both $\alpha$ and $\beta$ are constant angles.

As shown in FIG. 4, in the event that three angles, $\alpha+\beta+\kappa$ are prepared in advance under a condition, $0°<\alpha<90°$ $0°<\beta<90°$ $\alpha+\beta+\kappa=180°$, the following relationships can be determined.

After setting an eccentric distance O' , a small circle of a radius OA and a large circle of a radius O'B are drawn. At a selected turning point of the radius OA, when drawing a straight line AC forming an angle a with the radius OA through a point A, the angle $\alpha$ is made as a supplemental angle. After putting a point F at a selected position on the straight line AC, when drawing a straight line FG forming an angle κ with the straight line AC through the point F, the angle κ is made as a supplemental angle. Furthermore, after putting a point G at a selected position on the straight line FG, when drawing a straight line GH forming an angle β with the straight line FG through the point G, the angle β is made as a supplemental angle. Finally, a radius O'B parallel with the straight line GH and a straight line parallel with the straight line FG are drawn.

From the above-mentioned explanation, the following expression is clearly derived.

$$\angle ACD=\angle HCI=\angle HFG=\kappa \text{ and } \angle CBE=\angle CIH=\angle FGH=\beta$$

because FG//CI and GH//O'B

Accordingly, $$\angle CAD+\angle CBE+\angle ACD=\alpha+\beta+\kappa=180^\circ$$

In $$\Delta CAD,\ \angle CAD+\angle CDA+\angle ACD=180^\circ$$

Therefore, $$\angle CDA=\angle CBE$$

Finally, the radiuses OA and O'B are parallel because OD//O'B.

On the basis of FIG. 4, the following relationships can be determined.

By connecting straight lines HC and IC, a bent line HCI is made. When regarding this bent line HCI as a thin bar, it becomes a bent bar HCI with a bent angle κ. Assuming that a small circle of a radius OA is a small circle plate (a), a thin slot corresponding to a line segment AH is made in the small circle plate (a).

Assuming that a circle of a radius O'B' is a large circle plate (b), a large circle of a radius O'B is made as a line drawn on the large circle plate (b). A ring-shaped plate (c) having a width equal to the difference between the radiuses O'B and O'B' is made, and a thickness of the ring-shaped plate (c) is equivalent to the thickness of the small circle plate (a). A thin slot corresponding to a line segment BI is made on the ring-shaped plate (c). The ring-shaped plate (c) is put on the large circle plate (b) and is fixed thereon.

The bent bar, the large circle plate (b) and the small circle plate (a) which have the above-mentioned figures are combined as follows.

Assuming that an eccentric distance of the small circle (a) and the large circle (b) from the center of a main axis is O'O, the small circle plate (a) can be put on the large circle plate (b). In this case, the large circle plate (b) rotates around a point O', and the small circle plate (a) rotates around a point O. The bent bar HCI can smoothly move in the thin slots of the small circle plate (a) and the ring-shaped plate (c) when the bent bar is put into the slots.

Rotational power applied to the small circle plate (a) makes the large circle plate (b) rotate through the bent bar HCI as a carrying medium when the small circle plate (a) is rotated by the power. Then, the radius O'B drawn on the large circle plate (b) rotates parallel to the radius OA of the small circle on the small circle plate (a). This means that both of the circle plates (a) and (b) can rotate at the same angle and speed. Such a movement is achieved even if the eccentric distance of O'O is changed.

A method for determining a width of the bent line HCI is described by reference to FIG. 5.

First, the bent line HCI is drawn at a selected turning position of the radius OA of the small circle plate (a) by using α, β and κ on the following conditions: $0^\circ\angle\alpha\angle 90^\circ$, $0^\circ\angle\beta\angle 90^\circ$, $\alpha+\beta+\kappa=180^\circ$. This is carried out by the same method for making the drawings of the bent line HCI already mentioned. In FIG. 5, the radius OA of the small circle plate (a) and the radius O'B of the large circle plate (b) which correspond to the bent line HCI are parallel.

Second, a chord AJ having a certain length is drawn through a crossing point A between the bent line HCI and the small circle plate (a). The radius OJ through a point J is drawn. A central angle ε is fixed against the chord AJ. O'K is drawn parallel to the radius OJ. A chord BK through a point K is drawn. A central angle ρ is fixed against the chord BK. Through a point J, a straight line JP is drawn parallel to a straight line AH. Further, through a point K, a straight line KQ is drawn parallel to a straight line CI.

A crossing point L between the straight lines JP and KQ is fixed. A bent line PLQ which is combined by two the straight lines PL and LQ is drawn. From FIG. 5, the following relationships can be determined.

In a case of ∠BO'K and ∠AOJ, since OA and O'B are parallel and OJ and O'K are parallel, it follows that ∠BO'K=∠AOJ and ρ=ε. Therefore, the following mathematical expression can be formed since the two isosceles triangles ΔBO'K and ΔAOJ are similar.

Mathematical Expression 1

$$\overline{BK}=\frac{\overline{O'B}}{\overline{OA}}\overline{AJ}=\frac{1}{r}\overline{AJ}$$

Since the length of the chord AJ is fixed, the length of another chord BK is also naturally fixed. Therefore, in the bent lines HCI and PLQ, HC and PL are parallel at a selected space, and IC and QL are also parallel at a selected space.

Further, it is possible to determine the following relationships.

When drawing a vertical segment AM against a straight line CH through a point A, a length of the segment AM becomes h. Also when drawing a vertical segment BN perpendicular to a straight line CI through a point B, a length of the segment BN becomes d.

From FIGS. 3–5, the following mathematical expression is proved.

Mathematical Expression 2

$$\angle JAM=\angle OAJ-\angle OAM=$$

$$\angle OAJ-(\angle HAM-\angle HAO)=\frac{1}{2}(180^\circ-\varepsilon)-(90^\circ-\alpha)=\alpha-\frac{\varepsilon}{2}$$

$$\angle KBN=\angle RBN-\angle RBK=\angle RBN-(\angle O'BK-\angle O'BR)=$$

$$90^\circ-\left\{\frac{1}{2}(180^\circ-\rho)-\beta\right\}=\beta+\frac{\rho}{2}=\beta+\frac{\varepsilon}{2}$$

$$\overline{AJ}=2\overline{OA}\sin\frac{\varepsilon}{2}=2r\sin\frac{\varepsilon}{2}$$

$$\overline{BK}=2\overline{O'B}\sin\frac{\rho}{2}=2l\sin\frac{\varepsilon}{2}$$

$$h=\overline{AJ}\cos\angle JAM=2r\sin\frac{\varepsilon}{2}\cos\left(\alpha-\frac{\varepsilon}{2}\right)=r\,2\cos\left(\alpha-\frac{\varepsilon}{2}\right)\sin\frac{\varepsilon}{2}=$$

$$r\left\{\sin\left(\alpha-\frac{\varepsilon}{2}+\frac{\varepsilon}{2}\right)-\sin\left(\alpha-\frac{\varepsilon}{2}-\frac{\varepsilon}{2}\right)\right\}=r\{\sin\alpha-\sin(\alpha-\varepsilon)\}$$

-continued $$d = \overline{BK}\cos\angle KBN = 2l\sin\frac{\varepsilon}{2}\cos\left(\beta+\frac{\varepsilon}{2}\right) = l\,2\cos\left(\beta+\frac{\varepsilon}{2}\right)\sin\frac{\varepsilon}{2} = l\left\{\sin\left(\beta+\frac{\varepsilon}{2}+\frac{\varepsilon}{2}\right)-\sin\left(\beta+\frac{\varepsilon}{2}-\frac{\varepsilon}{2}\right)\right\} = l\{\sin(\beta+\varepsilon)-\sin\beta\}$$

Therefore, h and d become a known length.

When connecting the bent lines HCI and PLQ with segments AM and BN, it is possible to apply the width of h and d to the bent line HCI. So, when given a known width and thickness, the bent line HCI can become a bent vane.

Figure 2:
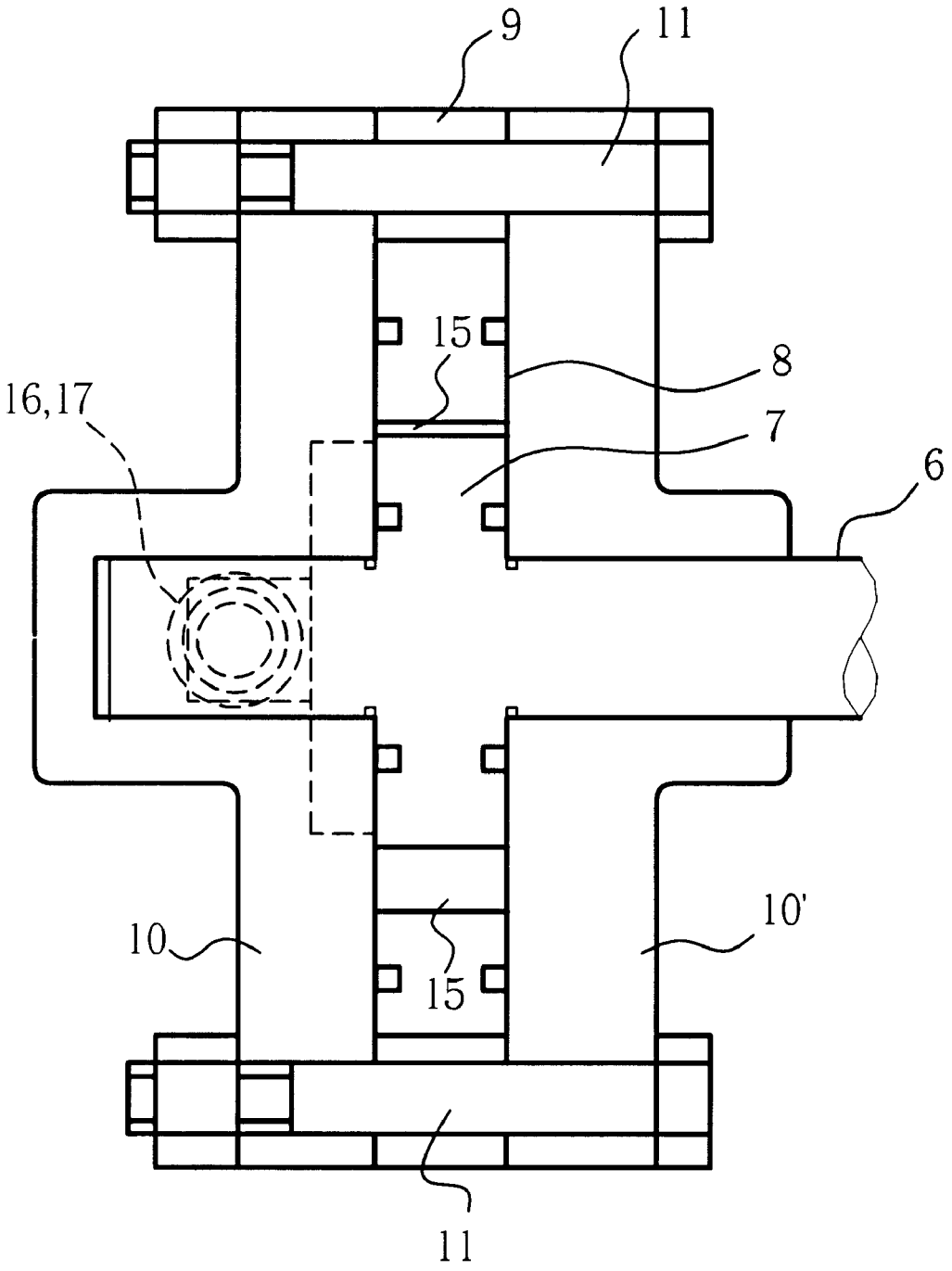
FIG. 2 is side view of a vane pump according to the invention.

Thus, the rotary mechanism shown in FIGS. 1 and 2 is objectively determined.

It is possible to use the positive-displacement piston mechanism of the invention as a positive-displacement piston mechanism having a rotary piston structure by setting an inlet (16) and an outlet (17) at suitable positions of side-housings (10) and (10') for applicable use, as shown in FIGS. 1 and 2.

Various exemplary embodiments of the invention are described below.

As shown in FIGS. 1 and 2, an inlet (16) and an outlet (17) are provided for a pump.

After dividing the outside-circumference of the small rotor (7) into n pieces (in this case, a value of n is suitably fixed), the sliding slots (12) are provided at equally divided positions. These slots (12) have a slant angle $\alpha$ against a radius r passing through the equally divided positions.

As the next step, after dividing the inside-circumference of the large rotor (8) into n pieces, the sliding slots (13) are provided at equally divided positions. These slots (13) have a slant angle $\beta$ against a radius l passing through the equally divided positions.

As shown in FIGS. 1–5, the bent vanes (14) are inserted into the slots. Each constant angle of FIGS. 3–5 is determined as described below.

On condition of $\alpha$=32°, $\beta$=43°, $\kappa$=105°, $\epsilon$=8°, since a ring-shaped space between the large rotor (8) and the small rotor (7) is divided by n bent vanes (14), n divided chambers (15) are made. When the small rotor (7), which is connected with main axis (6) of rotary piston rotates counter-clockwise, the small rotor makes the large rotor (8) rotate counter-clockwise through the bent vanes (14). At the same time, n divided chambers (15) rotate counter-clockwise.

Capacity of each divided chamber (15) increases and decreases once when the divided chamber (15) rotates counter-clockwise once. The fluid is sucked from the inlet (16) into the divided chamber (15) when the capacity in the divided chamber (15) increases. On the contrary, the fluid in the divided chamber (15) is sent out from an outlet (17) when the capacity in the divided chamber (15) decreases. Such a movement is the same as a pump. In this case, the quantity of fluid exhausted can be increased and decreased by changing the biased distance of the small rotor (7) and the large rotor (8).

Figure 6:
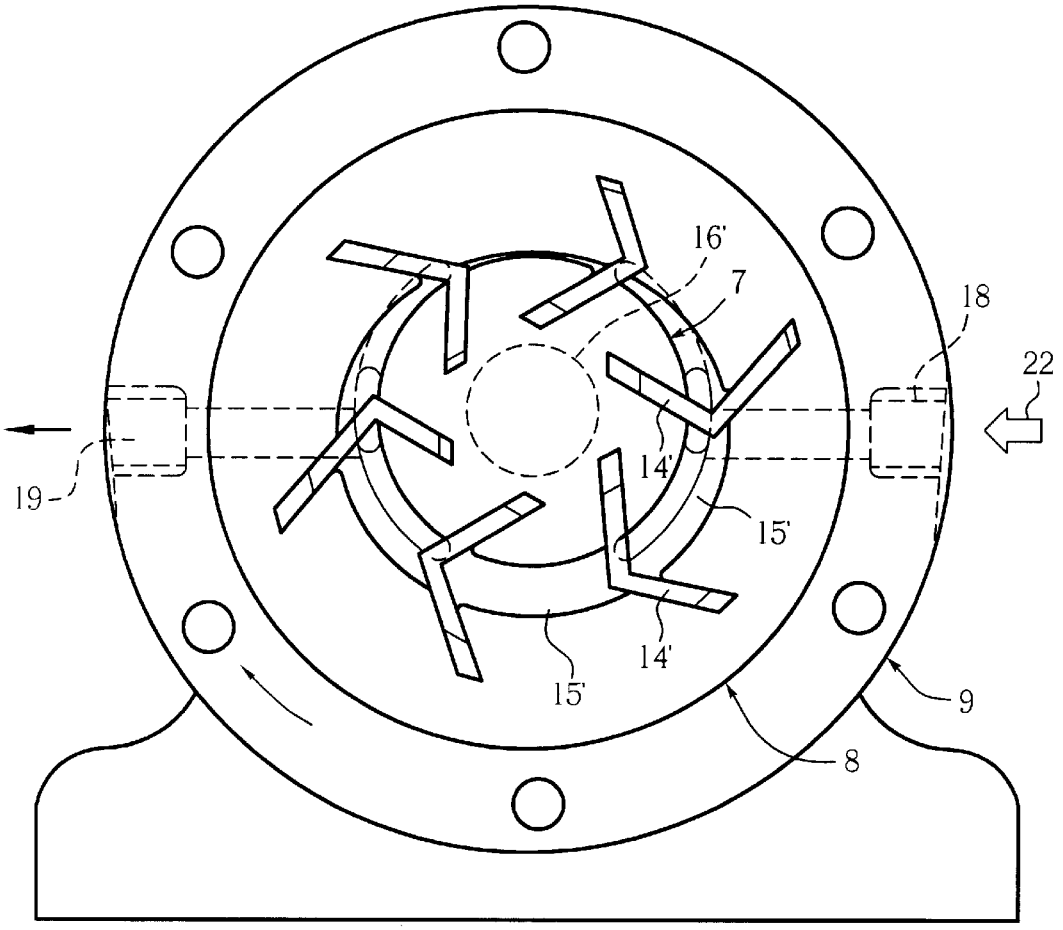
FIG. 6 is a front view of a positive-displacement piston mechanism according to the invention for a vane pump.

FIG. 6 shows the positive-displacement piston mechanism of the invention used in a bent vane pump.

As shown in FIG. 6, use of the positive-displacement piston mechanism in a vane pump is easily achieved by using outlet (17) as an inlet (18) and using inlet (16) as an outlet (19). A vane pump can be made by combining the positive-displacement piston mechanism with a device (22) that supplies high pressure fluid. The high pressure fluid from the device (22) is continuously supplied from the inlet (18) into the divided chamber (15') of the modified bent vane pump. The fluid that flows into the divided chamber (15') applies pressure to the bent vane (14'). The pressure on the bent vane makes the main axis (16') turn clockwise, and then the divided chamber (15') turns clockwise. The fluid in the divided chamber (15') is sent out from the outlet (19) when the divided chamber (15') is rotated to the outlet (19).

Figure 7:
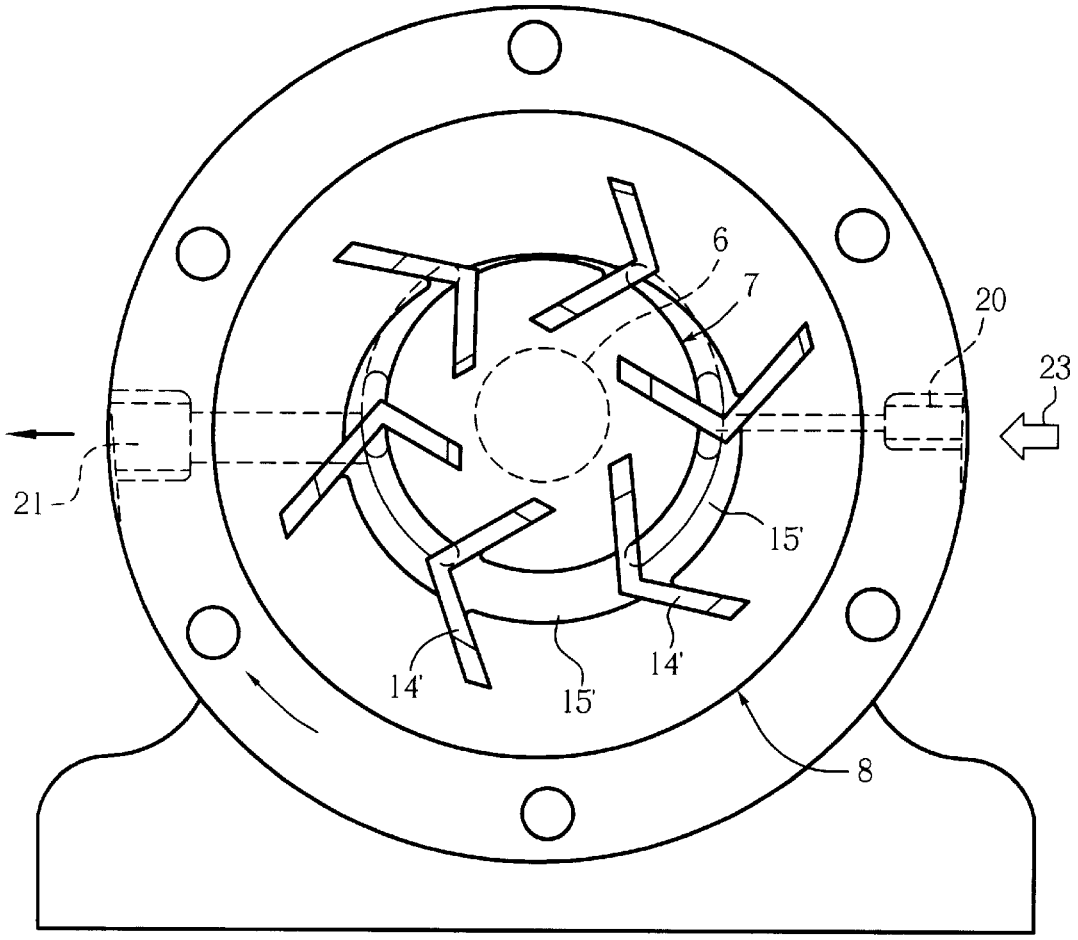
FIG. 7 is a front view of a positive-displacement piston mechanism according to the invention for a heating gas vane motor.
Figure 8:
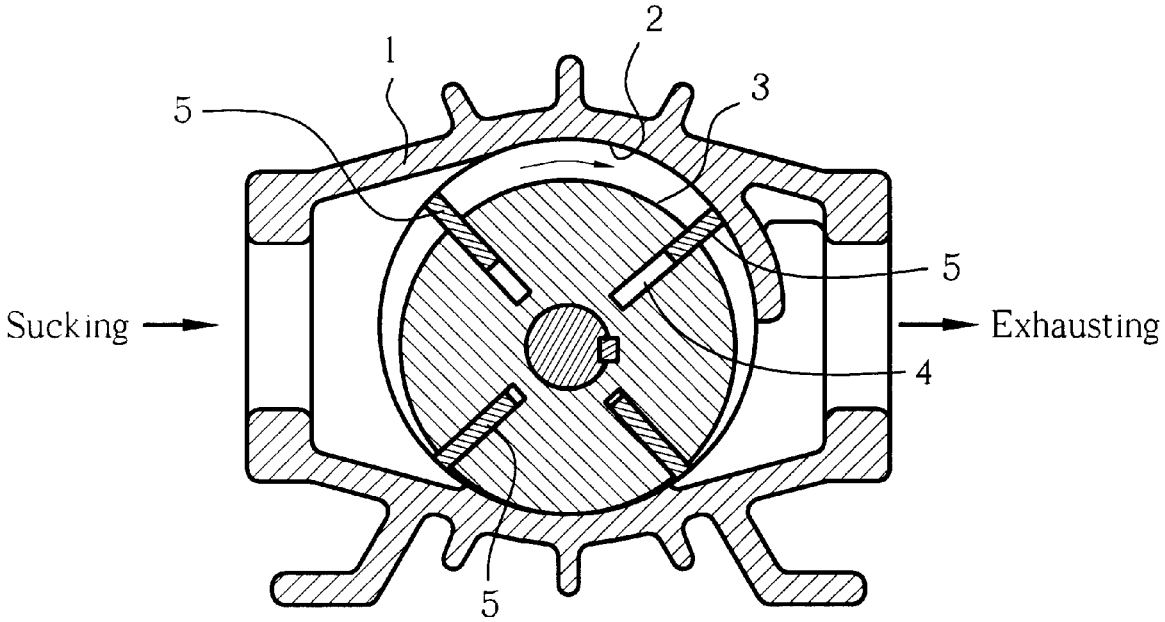
Fig. 8 Related Art
FIG. 8 is a front view of a rotary blower according to the prior art.

As shown in FIG. 7, in the bent vane motor, a small inlet (20) for obtaining heated gas is provided therein instead of an inlet (18) for the fluid. The the inlet (20) is placed at a position where the capacity begins to increase when the divided chamber (15') turns clockwise. An outlet (19) of the fluid of the bent vane motor becomes a gas-exhausting mouth (21) for sending the heated gas out. The bent vane motor operates as a heated gas bent vane motor.

When combining a device (23) supplying high temperature and pressure gas to the heated gas bent vane motor after a selection of a divided chamber (15') located at the inlet (20) of the heated gas out of n divided chambers (15') of the heated gas bent vane motor, rotors (7) and (8) rotate as as shown in FIG. 7.

First, high temperature and pressure gas from the high temperature and pressure gas supplying device (23) is continuously supplied into the divided chamber (15') at the inlet (20) for the heated gas. The high temperature and pressure gas which was supplied into the divided chamber (15') increases the pressure on a pair of bent vanes (14') forming the divided chamber (15'). Then, these two bent vanes (14') receive pressure which pushes them in opposite directions. However, a torque difference arises against the main axis (6) because there is a difference of space between the two bent vanes (14'). The torque difference makes the main axis (6) turn clockwise, and then the divided chamber (15') also turns clockwise.

Since capacity of the divided chamber (15') increases in proportion to a turning movement of the chamber (15'), the high temperature and pressure gas flows into the divided chamber (15'). Thus, both the main axis (6) and the divided chamber (15') continue to turn and move because the high temperature and pressure gas is continuously supplied to the bent vanes (14'). Next, when the divided chamber (15') turns past inlet (20), the high temperature and pressure gas stops flowing into the divided chamber (15'). After that, the high temperature and pressure gas in the divided chamber (15') adiabatically expands because of the increase of capacity when the divided chamber (15') turns. This is the reason why the main axis (6) continues to turn and the divided chamber (15') continues to turn because adiabatic expansion continuously applies pressure to the bent vane (14').

Furthermore, when the divided chamber (15') is rotated toward the outlet (21), the heated gas in the divided chamber (15') exits the outlet (21). As another divided chamber (15') comes to the inlet (20), the rotational power toward the main axis (6) is continuously provided by the supplying device (23). Therefore, the positive-displacement piston mechanism can operate as a heated gas bent vane motors.

The positive-displacement piston mechanism according to the invention has improved smoothness and sealing capability because the bent vanes forming the divided chambers only move at a portion of the bridge at the sliding slots when changing capacity.

What is claimed is:

1. A positive-displacement piston mechanism having a rotary piston structure, comprising:

a small rotor integrated with a main axis and biased against a cylindrical large rotor holding a bearing-housing, slant sliding slots formed in the small rotor and the large rotor at opposing positions between said large rotor and small rotor, vanes slidably fitted into said slots, each vane being bent at an angle κ, and an inlet and an outlet provided on side-housings, wherein the slant sliding slots are formed in the small rotor and the large rotor at equally spaced positions and each slot in the small rotor is formed at a first slant angle α against a respective radius of the small rotor passing through a respective equally spaced position and each slot in the large rotor is formed at a second slant angle β against a respective radius of the large rotor passing through a respective equally spaced position, and a width of each vane is defined by one of $$h=2\cdot r\cdot\sin(\epsilon/2)\cdot\cos(\alpha-\epsilon/2) \text{ and } d=2\cdot l\cdot\sin(\epsilon/2)\cdot\cos(\beta+\epsilon/2)$$

wherein h and d are a width of each vane, r is the radius of the small rotor, ϵ is a central angle fixed against a chord of the small rotor passing through two crossing points on an outer surface of the small rotor, the crossing points being on opposite sides of one of the vanes, l is the radius of the large rotor, and $0°<\alpha<90°$, $0°<\beta<90°$, and $\alpha+\beta+\epsilon=180°$.

2. A vane pump, comprising a positive-displacement piston mechanism having a rotary piston structure according to claim 1.

3. A vane motor, comprising a positive-displacement piston mechanism having a rotary piston structure according to claim 1.

4. A heat gas vane motor, comprising a positive-displacement piston mechanism having a rotary piston structure according to claim 1.

* * * * *

UNITED STATES PATENT AND TRADEMARK OFFICE

CERTIFICATE OF CORRECTION

PATENT NO. : 6,152,718
DATED : November 28, 2000
INVENTOR(S) : Hiroshi Kobayashi It is certified that error appears in the above-identified patent and that said Letters Patent is hereby corrected as shown below:

Column 2,
Line 41, replace "1" with -- 1 --;
Line 55, replace "OA/O'B" with -- OA//O'B --;
Line 56, replace "$\alpha+\beta\kappa=180^\circ$" with -- $\alpha+\beta+\kappa=180^\circ$ --;
Line 63, replace "O'" with -- O'O --;
Line 66, replace "a" with -- $\alpha$ --.

Column 8,
Line 5, replace "$\alpha+\beta+\varepsilon=180^\circ$" with -- $\alpha+\beta+\kappa=180^\circ$ --
Line 13, replace "heat gas vane motor" with -- heated gas vane motor --.

Column 6,
Line 7, delete "the" (third occurrence);
Line 17, delete "as" (second occurrence).

Signed and Sealed this

Thirtieth Day of October, 2001

*Attest:*

Nicholas P. Godici

*Attesting Officer*

NICHOLAS P. GODICI
*Acting Director of the United States Patent and Trademark Office*